US009664469B2

(12) United States Patent
DiChario

(10) Patent No.: US 9,664,469 B2
(45) Date of Patent: May 30, 2017

(54) SHOTGUN SHELL MAGAZINE

(71) Applicant: American Tactical Imports, Inc., Rochester, NY (US)

(72) Inventor: Anthony DiChario, Pittsford, NY (US)

(73) Assignee: American Tactical, Inc., Summerville, SC (US)

( * ) Notice: Subject to any disclaimer, the term of this patent is extended or adjusted under 35 U.S.C. 154(b) by 0 days.

(21) Appl. No.: 15/149,949

(22) Filed: May 9, 2016

(65) Prior Publication Data

US 2016/0327354 A1 Nov. 10, 2016

Related U.S. Application Data

(63) Continuation-in-part of application No. 14/707,683, filed on May 8, 2015, now abandoned.

(51) Int. Cl.

| | |
|---|---|
| ***F41A 9/61*** | (2006.01) |
| ***F41A 9/70*** | (2006.01) |
| ***F41A 9/62*** | (2006.01) |
| ***F41A 9/71*** | (2006.01) |

(52) U.S. Cl.
CPC *F41A 9/70* (2013.01); *F41A 9/62* (2013.01); *F41A 9/71* (2013.01)

(58) Field of Classification Search
CPC ..... F41A 9/70; F41A 9/62; F41A 9/71
USPC ..... 42/49.01
See application file for complete search history.

(56) References Cited

U.S. PATENT DOCUMENTS

| | | | | | |
|---|---|---|---|---|---|
| 4,109,401 | A * | 8/1978 | Musgrave | F41A 9/62 | 42/1.01 |
| 4,487,103 | A * | 12/1984 | Atchisson | F41A 9/73 | 89/33.02 |
| 5,309,660 | A * | 5/1994 | Blackamore | F42B 33/14 | 42/106 |
| 5,456,153 | A * | 10/1995 | Bentley | F41A 9/73 | 42/49.01 |
| 5,561,258 | A * | 10/1996 | Bentley | F41A 9/75 | 42/49.01 |
| 5,600,083 | A * | 2/1997 | Bentley | F41A 9/73 | 42/49.01 |
| 5,771,620 | A * | 6/1998 | Crawford | F41A 9/41 | 42/19 |
| 6,032,395 | A * | 3/2000 | Bentley | F41A 9/41 | 42/19 |
| 7,261,029 | B1 * | 8/2007 | Davis | F41A 17/36 | 42/16 |

(Continued)

*Primary Examiner* — Michelle R Clement
(74) *Attorney, Agent, or Firm* — Woods Oviatt Gilman LLP; Katherine H. McGuire, Esq.

(57) ABSTRACT

A shotgun shell magazine to be received within a mil-spec magazine of an M16/AR-15 mil-spec firearm is disclosed. The magazine has an open top end defining a cavity configured to receive one or more shotgun shells. The magazine body includes a feed lip which partially occludes the open top end and a rim edge including a vertical edge strip which defines a gap in communication with the cavity. A follower having a ramped upper surface resides within the cavity. The follower is biased to direct the shotgun shells toward the open top end until the primer end of a top most shotgun shell engages the feed lip. The top most shotgun shell is angled with respect to the open top end and at least a portion of the closed end of the top most shotgun shell lies above a plane created by the open top end.

9 Claims, 5 Drawing Sheets

(56) References Cited

U.S. PATENT DOCUMENTS 8,196,327 B2 * 6/2012 Rich ..... F41A 9/73 42/49.01
8,448,364 B2 * 5/2013 Davidson ..... F41A 9/69 42/50
8,667,724 B2 * 3/2014 Zheng ..... F41A 9/70 42/50
8,695,260 B2 * 4/2014 Kramer ..... F41A 5/18 42/69.02
8,752,317 B1 * 6/2014 Calvert ..... F41A 9/71 42/49.02
8,813,406 B1 * 8/2014 Sullivan ..... F41A 9/69 42/50
8,820,212 B2 * 9/2014 Rostocil ..... F41A 9/79 89/155
8,850,732 B2 * 10/2014 Zheng ..... F41A 9/70 42/49.02
8,887,428 B1 * 11/2014 Lemoine ..... F41A 9/61 42/49.01
8,898,946 B1 12/2014 Johnson
8,966,801 B1 * 3/2015 Bentley ..... F41A 9/71 42/49.01
9,121,614 B2 * 9/2015 Kramer ..... F41A 5/18
9,255,749 B2 * 2/2016 Faifer ..... F41A 9/65
9,267,749 B1 * 2/2016 Dukart ..... F41A 9/71
9,372,040 B2 * 6/2016 Zheng ..... F41A 9/71
2005/0150148 A1 * 7/2005 Herpel ..... F41A 9/67 42/50
2007/0157501 A1 * 7/2007 Cammenga ..... F41A 9/67 42/87
2008/0028659 A1 * 2/2008 Moretti ..... F41A 9/62 42/1.02
2010/0115815 A1 * 5/2010 Gur-Ari ..... F41A 9/62 42/1.02
2010/0269389 A1 * 10/2010 Lopez Laparra ..... F41A 9/68 42/49.01
2010/0281737 A1 11/2010 Cahill
2010/0313458 A1 12/2010 Aalto
2011/0005383 A1 * 1/2011 Kramer ..... F41A 5/18 89/191.01
2011/0079132 A1 * 4/2011 Rich ..... F41A 9/74 89/33.02
2012/0066950 A1 * 3/2012 Davidson ..... F41A 9/70 42/50
2012/0144712 A1 * 6/2012 Rostocil ..... F41A 9/79 42/16
2012/0151813 A1 * 6/2012 Brown ..... F41C 7/00 42/73
2013/0167420 A1 * 7/2013 Zheng ..... F41A 9/70 42/50
2013/0167421 A1 * 7/2013 Zheng ..... F41A 9/70 42/50
2014/0137453 A1 * 5/2014 Lamb ..... F41A 9/01 42/6
2014/0150315 A1 * 6/2014 Russell ..... F41A 9/65 42/50
2014/0215878 A1 * 8/2014 Fitzpatrick ..... F41A 9/62 42/50
2014/0223789 A1 * 8/2014 Kramer ..... F41A 5/18 42/25
2014/0325886 A1 * 11/2014 Mather ..... F41A 17/38 42/6
2014/0352189 A1 * 12/2014 Fitzpatrick ..... F41A 9/69 42/50
2014/0366417 A1 * 12/2014 Zheng ..... F41A 9/71 42/50
2014/0373416 A1 12/2014 Barnhart
2015/0101228 A1 * 4/2015 Giannini ..... F41A 21/00 42/49.02
2015/0113848 A1 * 4/2015 Monveldt ..... F41C 23/04 42/16
2015/0121736 A1 * 5/2015 Faifer ..... F41A 9/65 42/49.01
2015/0176938 A1 * 6/2015 Micklethwaite ..... F41A 19/18 89/127
2015/0226504 A1 * 8/2015 Faifer ..... F41A 9/65 42/50
2015/0241152 A1 * 8/2015 Fitzpatrick ..... F41A 9/69 42/50
2015/0276336 A1 * 10/2015 Lamb ..... F41A 9/01 42/6
2015/0308766 A1 * 10/2015 Bentley ..... F41A 9/71 42/50
2016/0025463 A1 * 1/2016 Kramer ..... F41A 5/18 102/501
2016/0109201 A1 * 4/2016 Fitzpatrick ..... F41A 9/70 29/428
2016/0123688 A1 * 5/2016 Faifer ..... F41A 9/65 42/50
2016/0123710 A1 * 5/2016 Kramer ..... F41A 5/18 42/25
2016/0161201 A1 * 6/2016 Langevin ..... F41A 3/66 42/75.02

* cited by examiner

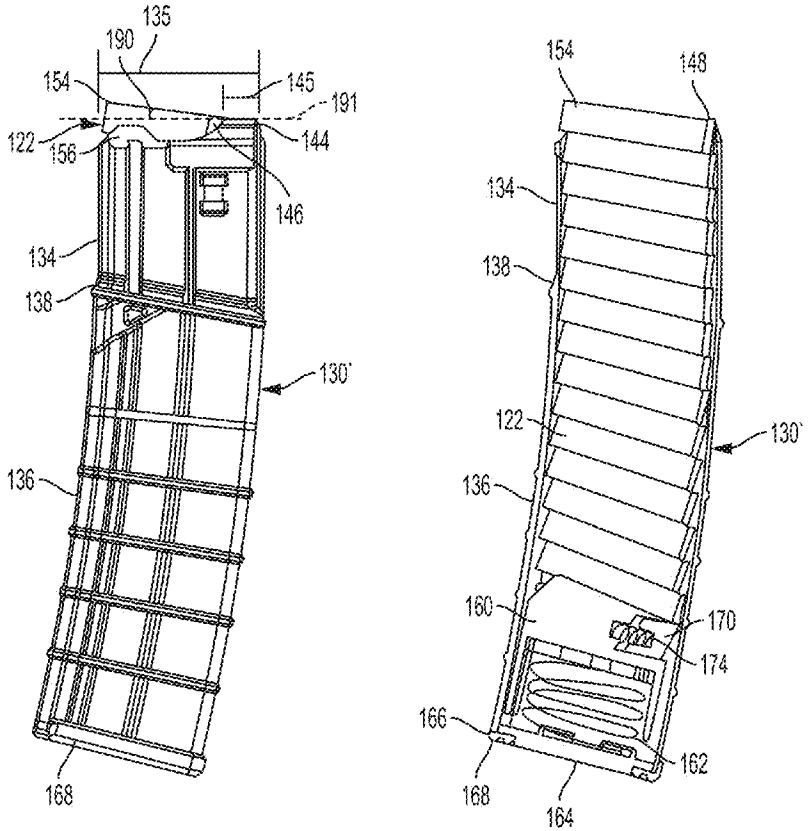
FIG. 5
FIG. 6
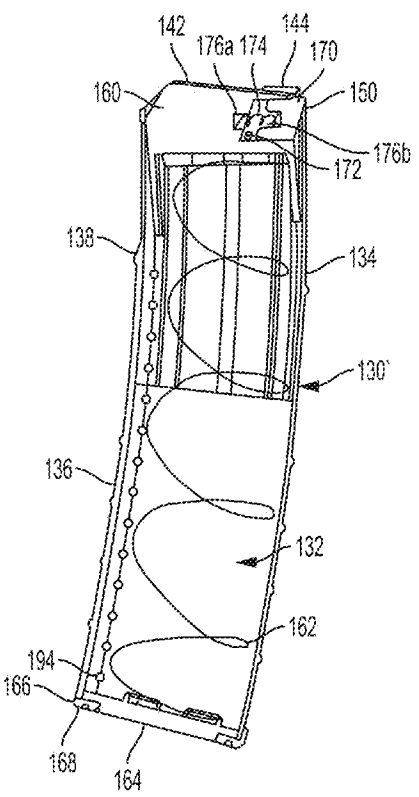
FIG. 7

SHOTGUN SHELL MAGAZINE

FIELD OF THE INVENTION

The present invention relates to a shotgun shell magazine, and more particularly, to a shotgun shell magazine configured to be used with an automatic or semi-automatic assault-type firearm. Specifically, the present invention relates to a shotgun shell magazine configured for use with an M-16/AR-15 firearm.

BACKGROUND OF THE INVENTION

There are a number of automatic and semi-automatic firearms used by military personnel as well as civilians. While fully automatic firearms are generally illegal for use by the civilian population, many of the components which constitute an automatic firearm are the same as those found with legal semi-automatic models. Arguably the most popular semi-automatic assault-type firearm used by civilians, particularly within the United States, is the AR-15. The AR-15 is the semi-automatic variant of the fully automatic M16 firearm used by United States military personnel. (AR-15 is a registered trademark of Colt Industries. A number of additional manufacturers manufacture clones of the AR-15 and market these clones under separate trademarks. While used throughout the specification, it is to be understood that the term AR-15 is meant to include not only those firearms manufactured by Colt Industries, but also those additional clones and any variants thereof).

The AR-15 and M16 are designed as modular firearms generally comprising a buttstock, lower receiver, upper receiver and barrel assembly. Each component is separable from one another and affords firearm owners the opportunity to customize the firearm with after-market components such as barrels of differing lengths, upper receivers designed to handle different calibers of ammunition, flashlights, hand guards, grenade or flare launchers, flash or sound suppressors, grips, and front or rear sights. To operate, the lower receiver is configured to include a trigger wherein activation of the trigger causes a cartridge housed within the chamber of the upper receiver to be fired out the barrel of the firearm by action of a reciprocating bolt carrier group. Internal mechanisms of the upper receiver expel the shell casing of the fired cartridge from the chamber while components engaged with the magazine housed within the magazine well of the lower receiver feed a new cartridge into the now-empty chamber. The buttstock mounts to the lower receiver and includes a buffer assembly and action (or recoil) spring in communication with the bolt carrier group where the spring pushes the bolt carrier group back toward the chamber in preparation of firing another cartridge.

To date, most automatic and semi-automatic firearms, like the AR-15, have been configured to fire rifle cartridges. Attempts to modify these firearms, and particularly the AR-15, to fire shotgun shells have run into a number of problems. For instance, AR-15 have been modified to accommodate .410 bore shells but these modifications require lower receivers which no longer satisfy military specifications. Other modifications continue to result in jamming or binding of the shotgun shells when a shell has been fired, is being ejected, or is being extracted from the magazine and loaded within the chamber.

As such, there is a need for a shotgun shell magazine which is configured to mount within a lower receiver, such as that of an M-16 or AR-15, having a magazine well meeting military specifications. The present invention addresses these and other needs.

BRIEF SUMMARY OF THE INVENTION

In general, an embodiment the present invention is directed to a shotgun shell magazine for use in a firearm. The magazine is detachably received within a magazine well on the firearm with the firearm configured to strip a shotgun shell from the magazine and load the shotgun shell into a firearm chamber. The magazine comprises a magazine body having an open top end and defines a cavity configured to receive one or more shotgun shells. The magazine body includes a feed lip configured to partially occlude the open top end and a rim edge including a vertical edge strip which defines a gap in communication with the cavity. A follower resides within the cavity and is biased to direct the one or more shotgun shells toward the open top end until a top most shotgun shell engages the feed lip.

In a further aspect of the present invention, the feed lip has a length between about 10% and about 25% of the total length of the open top end, and may further be about 20% of the total length of the open top end. The follower may also be biased by a magazine spring where a first end of the magazine spring engages the follower and a second end of the magazine spring engages a floor plate secured to a bottom edge of the magazine body. The follower may also include a magazine stop configured to engage a bolt catch on the firearm after the last of the one or more shotgun shells has been loaded into the firearm chamber.

In still a further aspect of the present invention, each shotgun shell may have a primer end and an opposing closed end. The follower may also include a ramped upper surface whereby the follower is biased to direct the one or more shotgun shells toward the open top end until the primer end a top most shotgun shell engages the feed lip such that the top most shotgun shell is angled with respect to the open top end and at least a portion of the closed end of the top most shotgun shell lies above a plane created by the open top end of the magazine body.

In yet a further aspect of the present invention, the magazine body may include a plurality of indicator holes and the follower may include an extended leg wherein the extended leg coincides with an individual indicator hole in the magazine body so as to indicate a number of shotgun shells remaining in the cavity. The extended leg may also include a colored indicator portion configured to be viewed by a user.

In a further embodiment of the present invention, a shotgun shell magazine for use in a firearm may comprises a magazine body having an open top end and defining a cavity configured to receive one or more shotgun shells. Each shotgun shell may have a primer end and an opposing closed end. The magazine body may also include a feed lip configured to partially occlude the open top end. A follower having a ramped upper surface resides within the cavity and the follower is biased to direct the one or more shotgun shells toward the open top end until the primer end a top most shotgun shell engages the feed lip. In this manner, the top most shotgun shell is angled with respect to the open top end and at least a portion of the closed end of the top most shotgun shell lies above a plane created by the open top end of the magazine body.

A still further embodiment of the present invention is directed to a shotgun shell magazine for use in an M16/AR-15 military specification (mil-spec) firearm. The magazine is detachably received within a mil-spec magazine well on the M16/AR-15 and the M16/AR-15 is configured to strip a shotgun shell from the magazine and load the shotgun shell into a M16/AR-15 chamber. The magazine comprises a magazine body having an open top end and defining a cavity configured to receive one or more shotgun shells. Each shotgun shell has a primer end and an opposing closed end and the magazine body includes a feed lip configured to partially occlude the open top end. The feed lip may have a length between about 10% and about 25% of the total length of the open top end. A follower having a ramped upper surface resides within the cavity and the follower is biased to direct the one or more shotgun shells toward the open top end until the primer end a top most shotgun shell engages the feed lip. In this manner, the top most shotgun shell is angled with respect to the open top end and at least a portion of the closed end of the top most shotgun shell lies above a plane created by the open top end of the magazine body.

In a further aspect of the present invention, the rim edge may further define a recess wherein the recess is configured to receive a rimmed end of a nominal 2.5 inch long .410 bore shotgun shell.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein:

FIG. 5 is a side view of the shotgun shell magazine shown in FIG. 4;

FIG. 6 is a cross section view of the shotgun shell magazine shown in FIG. 5 with fifteen shotgun shells loaded into the magazine;

FIG. 7 is a cross section view of the shotgun shell magazine shown in FIG. 6 showing the magazine empty of shotgun shells;

DETAILED DESCRIPTION OF THE INVENTION

Figure 1:
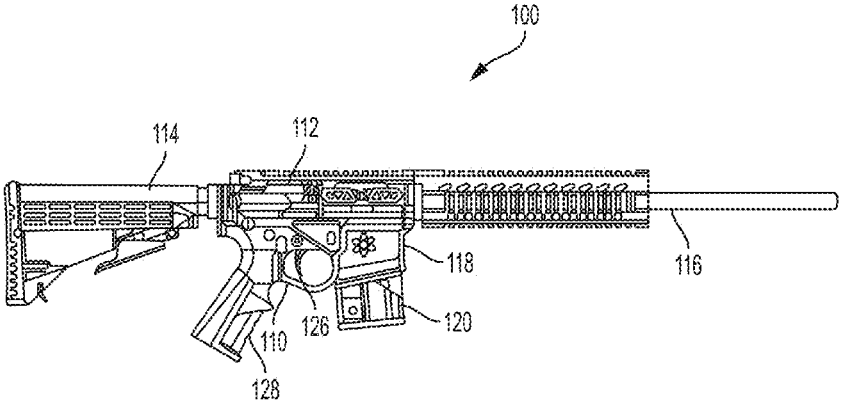
FIG. 1 is a side view of a representative firearm amenable for use with an embodiment of a shotgun shell magazine in accordance with the present invention.
Figure 2:
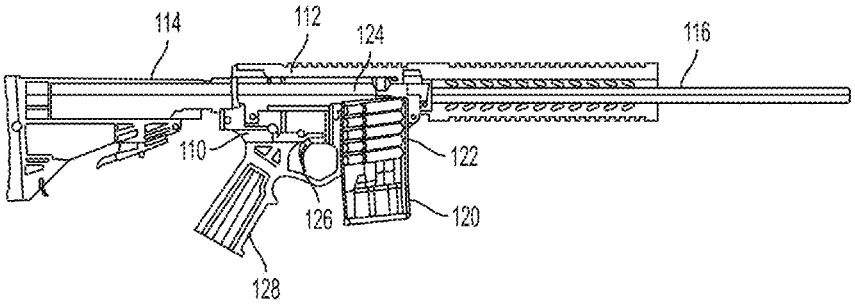
FIG. 2 is a cross sectional view of the firearm shown in FIG. 1.

Referring to the drawings in detail, and specifically to FIGS. 1 and 2, a firearm, such as the AR-15, is generally indicated by reference numeral 100. Firearm 100 may be a modular firearm consisting of a number of components and subcomponents. Major components of firearm 100 may include lower receiver assembly 110, upper receiver assembly 112, buttstock assembly 114 and barrel assembly 116. To assemble a completed firearm, upper receiver assembly 112 is coupled to lower receiver assembly 110 while buttstock assembly 114 is connected to the lower receiver assembly 110 and barrel assembly 116 is mounted onto upper receiver assembly 112. Lower receiver assembly 110 is configured to include a magazine well 118 adapted to slidably receive a magazine 120 therein. Magazine 120 may carry one more cartridges, bullets or shells 122 which may be serially loaded within a chamber 124 in upper receiver assembly 112. Activation of the firing mechanism (not shown) is controlled by trigger 126. A grip 128 (such as a pistol grip, as shown) allows the user to aim and control the firearm while placing the user's trigger index finger in close proximity to the trigger. In this manner, the user can aim the firearm to the target and extend the trigger index finger to engage the trigger without losing control or accuracy of the firearm.

Most assault-type firearms are configured to be operated as rifles and include a rifled barrel and are chambered to receiver and fire rifle cartridges. By way of example, the most ubiquitous civilian assault weapon, the AR-15, is generally chambered for standardized rounds such as the Remington .223 cartridge or the 5.56×45 mm NATO military cartridge. As a result, magazines, and more importantly the magazine well configured to receive these magazines, of the AR-15 have been standardized, with such standardization being generally referred to as meeting United States Military Standards or, more commonly as being "mil-spec". Specifically, as used herein, the terms "mil-spec" and "mil-spec M16/AR-15" shall refer to the structural specificities defined by the United States Department of Defense as of May 8, 2015, the date of filing of U.S. application Ser. No. 14/707,683, the parent application to the instant continuation-in-part application. Assault weapons, such as the AR-15, have also been modified to chamber and fire .410 bore shotgun shells. However, these firearms suffer from a number of drawbacks. For instance, 2.5 inch long shotgun shells tend to bind within the chamber and/or magazine thus leading to performance failures. In an attempt to alleviate these binding issues, firearms have been modified such that the magazine well of the lower receiver is slightly larger than the standard AR-15 magazine well such that the larger magazine well can receive a larger magazine such that the shotgun shells can more repeatably be extracted from the magazine and chambered within the upper receiver. This modification, however, renders the lower receiver assembly no longer mil-spec and also leads to difficulties when mating the upper and lower receivers.

As shown in FIGS. 2-6, an embodiment of a shotgun shell magazine 120/120' of the present invention is configured to reside within the magazine well 118 of a mil-spec AR-15 firearm 100. Shotgun shell magazine 120 includes a magazine body 130 that may be proportioned so as to define a 5 round magazine (i.e. can receive a maximum of five .410 bore shotgun shells 122). See FIG. 3. However, alternative capacity magazines, such as a 15 round magazine 120' (see FIG. 4), may be constructed in accordance with the teachings of the present invention as will be discussed more fully below. It should be understood by those skilled in the art that magazines may be produced which include any desired capacity and that such alternative magazines are to be considered within the teachings of the present invention.

Figure 4:
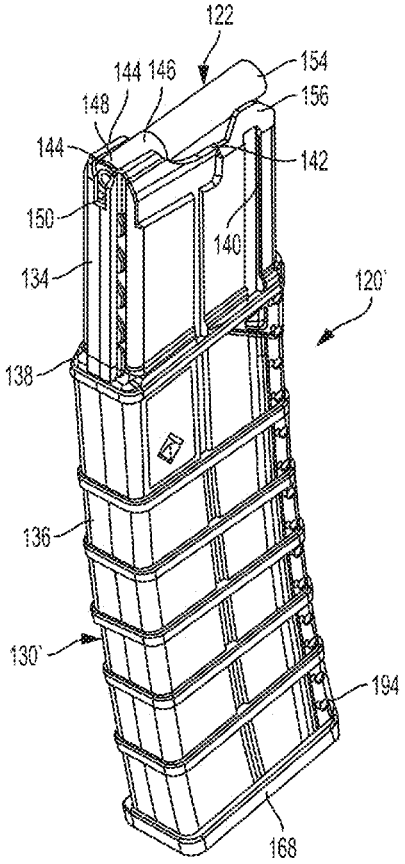
FIG. 4 is a perspective view of an embodiment of a fifteen shell capacity shotgun shell magazine in accordance with the present invention.

With reference to FIGS. 4-6, magazine 120' is generally comprised of a magazine body 130' defining a magazine cavity 132. Cavity 132 is proportioned to receive one or more shotgun shells 122. In accordance with one aspect of the present invention, shotgun shells 122 are 2.5 inch long .410 bore shotgun shells filled with either shot or slugs. The portion 134 of magazine body 130' may be slightly narrower than the remainder 136 of magazine body 130' so as to form a step 138. Portion 134 is proportioned to be removably insertable within magazine well 118 (see FIG. 1) while step 138 abuts the lower periphery of magazine well 118 so that magazine 120' is properly loaded within magazine well 118. To that end, portion 134 may include one more grooves 140 that mate with corresponding ridges (not shown) defined on the internal faces of magazine well 118 to ensure that magazine 120' is mounted within firearm 100 in the proper orientation.

The top edge 142 of magazine body 130' generally defines an opening to cavity 132 such that shotgun shells 122 may pass out from magazine 120' and into chamber 124 of upper receiver assembly 112 (see FIG. 1). To allow controlled, selective extraction of a single shotgun shell 122, a feed lip portion 144 of top edge 142 is configured to extend around and partially encircle the metal casing 146 at the rim end 148 of the top most shotgun shell 122. In accordance with an aspect of the present invention, a length 145 of feed lip portion 144 is proportioned to be less than about 25% of the total length 135 of portion 134 of magazine body 130', in more particularly about 20% of the total length 135. In this manner, shotgun shells 122 may be serially extracted from magazine by the bolt carrier (not shown) within the upper receiver assembly 112 without jamming or binding the shotgun shell 122 within magazine body 130' or chamber 124 as is known with current attempts at providing AR-15 magazines for .410 bore shotgun shells. To that end, magazine body 130' may define a recess 150 configured and positioned such that the bolt carrier can engage metal casing 146 to slide the shotgun shell 122 beyond the feed lip portions 144. Once shotgun shell 122 clears the obstruction created by feed lip portions 144, the shotgun shell 122 can then be directed into chamber 124 for eventual firing. To control lateral movement of the plastic hull portion 154 of shotgun shell 122, top edge 142 may further include upwardly extending guide lips 156.

Housed within cavity 132 of magazine body 130' is a follower 160 onto which are loaded one more shotgun shells 122. Follower 160 is biased upwardly toward top edge 142 by way of a biasing member 162. Biasing member 162 may be a magazine spring as is known in the art. The opposing end of biasing member 162 may be fastened to a floor plate 164 which in turn is secured to the bottom edge 166 of magazine body 130'. Floor plate 164 may be directly fastened to bottom edge 166 or may be constrained within cavity 132 by a magazine base plate 168 which is fastened or physically bonded to bottom edge 166. Biasing member 162 exerts a spring force against follower 160 such that the top most shotgun shell 122 is constrained within magazine body 130' by feed lip portions 144 as discussed above. Once a shotgun shell has been fired and the next subsequent shotgun shell extracted by the bolt carrier, follower 160 through urging of biasing member 162 advances the immediately next shotgun shell 122 until this next shell engages the feed lip portions. Shotgun shells 122 continue to load within chamber 124 upon repeated firing of the firearm 100 until such time the last shotgun shell is loaded into the chamber.

Upon loading of the bottom most shotgun shell 122 within chamber 124, a magazine stop 170 resident within a stop cavity 172 defined within follower 160 may be biased outwardly via a stop biasing member 174 housed within combined bore **176*a*, 176*b* in follower 160 and stop 170, respectively (see FIG. 7). The outwardly extending magazine stop 170 may then engage the bolt catch (not shown) in the lower receiver to stop the bolt's travel thereby enabling the bolt to be locked to the rear (toward buttstock 114). The empty magazine can then be removed from magazine well 118 and a new, loaded magazine may then be inserted. The bolt catch may then be disengaged such that the bolt carrier may strip the top most shotgun shell from the newly loaded magazine. When magazine 120' contains one or more shotgun shells 122, biasing member 174 is compressed by magazine stop 170 engaging the internal surface of magazine body 130' such that magazine stop rides along the internal surface until such time as the bottom most shotgun shell 122 is loaded within chamber 124 and magazine stop extends outwardly from recess 150** as described above.

Figure 8:
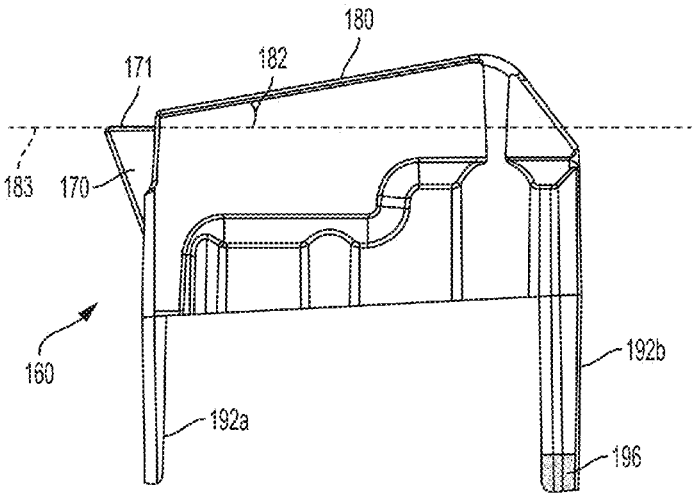
FIG. 8 is a side with of a follower amenable for use within an embodiment of a shotgun shell magazine in accordance with the present invention.
Figure 9:
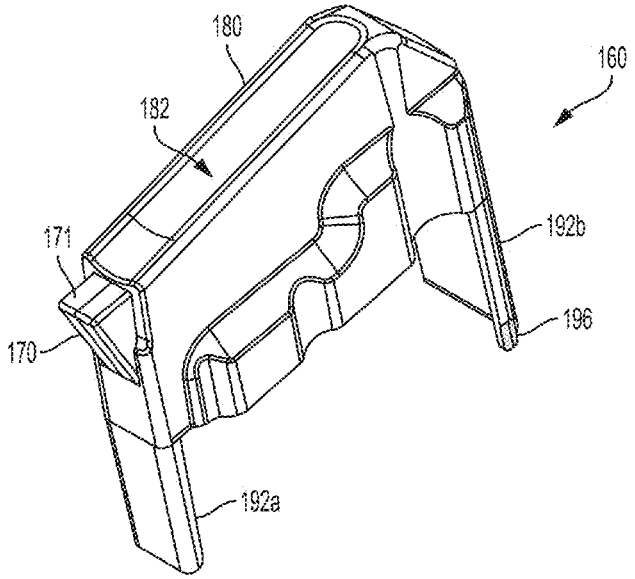
FIG. 9 is a perspective view of the follower shown in FIG. 8.

Turning now to FIGS. 8 and 9, an isolated view of follower 160 is shown. As shown most clearly in FIG. 8, follower 160 is configured include a ramped upper surface 180 extending at an angle 182 with respect to the plane 183 defined by top face 171 of magazine stop 170. As seen in FIG. 9, ramped upper surface 180 may be adapted to include a concave recess 184. Concave recess 184 may be configured to have a radius equal to or slightly larger than the external circumference of a standard .410 bore shotgun shell 122. In this manner, shotgun shell 122 should nest within recess 184 such that rolling of shotgun shell 122 on ramped upper surface 180 is reduced, particularly once shotgun shell 122 has disengaged from feed lip portions 144 upon being loaded into chamber 124 as described above. Ramped upper surface 180 of follower 170, coupled with feed lip portions 144, causes at least a portion of the closed (i.e. crimped or rolled) end 154 of top most shotgun shell 122 to extend externally from magazine body 130' at an angle 190 with respect to a plane 191 created by feed lip portions 144 while the metal casing 146 engages feed lip portions 144 (see FIG. 5). As described above, upwardly extending guide lips 156 of magazine housing 130' aid in preventing lateral movement of the top most shotgun shell 122. Angling of the top most shotgun shell 122 in such a manner facilitates proper stripping and chambering of the shotgun shell by the bolt carrier during reloading of firearm 100.

In accordance with a further aspect of the present invention, follower 160 may include one or more downwardly extending legs **192*a*, 192*b*. These downwardly extending legs may facilitate placement and compressive loading of magazine biasing member 162. Magazine body 130' may include a plurality of indicator holes 194 (see FIGS. 4 and 7) which are spaced apart from one another such that as follower 160 is biased upwards through subsequent loading of successive shotgun shells as described above, an indicator portion 196 on follower 160 is viewable through the respective indicator hole which corresponds to the number of shotgun shells 122 remaining within magazine 120'. In this manner, the firearm user may monitor the number of shells remaining by visually determining where the indicator portion 196 is located along magazine body 130'. If follower 160 is fabricated of materials identical to or similar to magazine body 130' such that visually interrogation of the magazine body 130'/follower 160 does not readily indicate the number of shells remaining, identifier portion 196 on one or both of legs 192*a*, 192*b* (such as leg 192*b* as shown in FIGS. 8 and 9) may be colored so as to be more readily viewable by the firearm user through indicator holes 194**.

Figure 3:
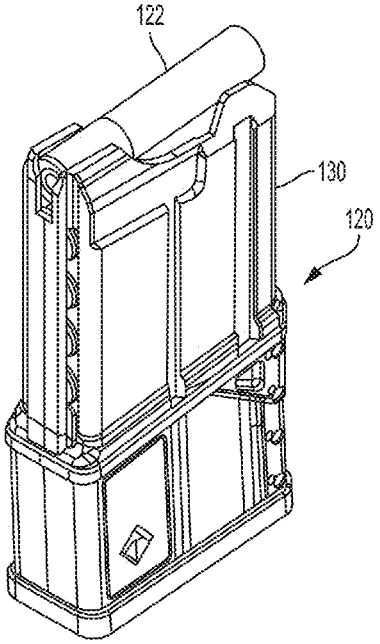
FIG. 3 is a perspective view of an embodiment of a five shell capacity shotgun shell magazine in accordance with the present invention.
Figure 10:
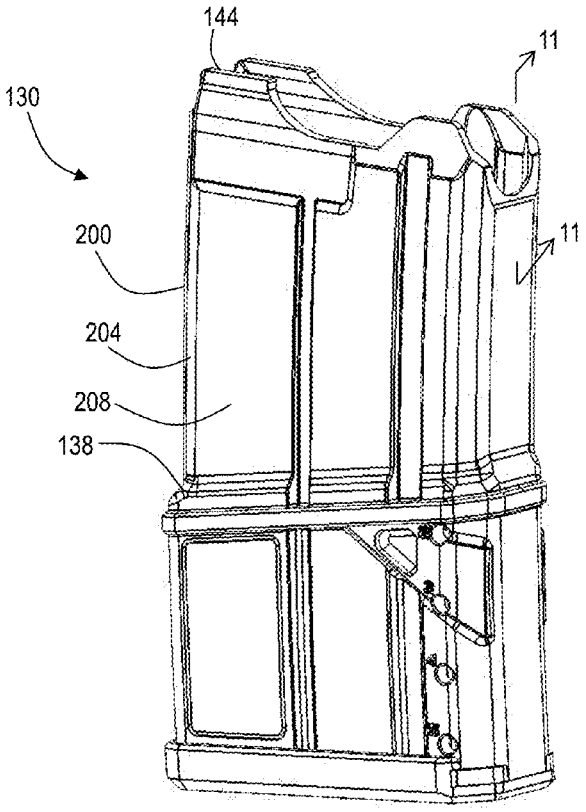
FIG. 10 is a perspective view of an embodiment of a five shell capacity shotgun shell magazine in accordance with a further aspect of the present invention.
Figure 11:
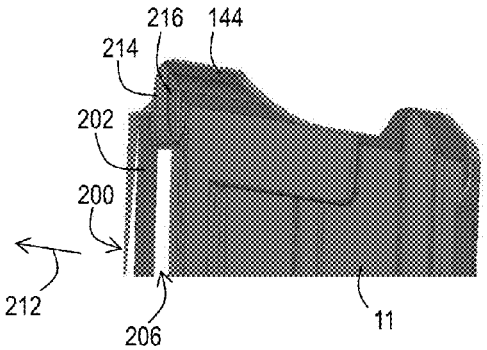
FIG. 11 is an expanded cross section view of the five shell capacity shotgun shell magazine shown in FIG. 10 taken generally along line 11-11.

Turning now to FIGS. 10 and 11, in a further aspect of the present invention, magazine body 130 may be configured to include additional features adapted to permit loading and extraction of 2.5 inch long .410 bore rimmed shotgun shells (such as shotgun shell 122 shown in FIGS. 3 and 4). Specifically, magazine body 130 (and, if desired, magazine body 130') may include a rim edge 200 having a vertical edge strip 202 affixed at one end to feed lip portions 144 and at step 138 at the other. Vertical edge strip 202 defines respective edge gaps 204, 206 with front panel 208 and rear panel 210 respectively. Gaps 204, 206 may run the entire length of vertical edge strip 202 (i.e. from proximate feed lip portions 144 to step 138) or may be selected to run only a selected portion of vertical edge strip 202. In this manner, vertical edge strip 202 is able to flex outwardly from the magazine body 130, 130' as generally indicated by arrow 212. As a result, magazine body 130, 130' may flex so as to accommodate 2.5 inch long shells that are slightly longer than the nominal 2.5 inches without causing an offending shell to become lodged within magazine thereby rendering the magazine inoperable.

Rim edge 200 in conjunction with feed lip walls 214 may define a recess 216. Recess 216 may be configured to provide additional clearance when receiving rim end 148 of shotgun shell 122. As a result, magazine body 130, 130' may be fabricated to be received within a mil spec AR15/M16 magazine well while being loaded with one or more 2.5 inch long .410 bore shotgun shells. Recess 216 may further assist in angling a topmost shotgun shell 122 as discussed above and as shown in FIGS. 2-6.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A shotgun shell magazine for use in an M16/AR-15 military specification (mil-spec) firearm, the mil-spec M16/AR-15 firearm configured to strip a shotgun shell from the magazine and load the shotgun shell into a M16/AR-15 chamber, the magazine comprising:

a) a magazine body including a front panel, rear panel, forward edge and rim edge defining an open top end and a cavity proportioned to slidably receive one or more nominal 2.5 inch long .410 bore shotgun shells, an external step formed on the front panel, rear panel, forward edge and rim edge, the step dividing the magazine body into a magazine well portion and an external portion, the magazine well portion dimensioned to be detachably received within a mil-spec magazine well on a mil-spec M16/AR15 firearm, a feed lip extending upwardly from each of the front panel and rear panel, each feed lip partially occluding the open top end proximate the rim edge, a feed lip wall joining each feed lip on its respective front or rear panel to the rim edge, the rim edge including a vertical edge strip extending from the feed lip walls to the external step on the rim edge, the vertical edge strip, feed lip walls and each front and rear panel defining a closed gap in communication with the cavity; and b) a follower resident within the cavity and having a ramped upper surface, the follower biased toward the open top end whereby, when the magazine is loaded with one or more shotgun shells, a top most shotgun shell is angled with respect to the open top end and at least a portion of a closed end of the top most shotgun shell lies above a plane created by the open top end of the magazine body.

2. The magazine in accordance with claim 1 wherein each feed lip has a length of between about 10% and about 25% of the total length of the open top end.

3. The magazine in accordance with claim 2 wherein each feed lip has a length of about 20% of the total length of the open top end.

4. The magazine in accordance with claim 1 wherein the follower is biased by a magazine spring.

5. The magazine in accordance with claim 4 wherein a first end of the magazine spring engages the follower and a second end of the magazine spring engages a floor plate secured to a bottom edge of the magazine body.

6. The magazine in accordance with claim 1 wherein the follower includes a magazine stop biased to extend outwardly from the rim edge of the magazine body by a biasing member, the magazine stop resident within the magazine when one or more shotgun shells are loaded in the magazine body, the biasing member biasing the magazine stop outwardly to engage a bolt catch on the mil-spec M16/AR-15 firearm after the last of the one or more shotgun shells has been loaded into the M16/AR-15 chamber.

7. The magazine in accordance with claim 1 wherein the magazine body includes a plurality of indicator holes and the follower includes an extended leg wherein the extended leg coincides with an individual indicator hole in the magazine body so as to indicate a number of shotgun shells remaining in the cavity.

8. The magazine in accordance with claim 7 wherein the extended leg includes a colored indicator portion configured to be viewed by a user.

9. The magazine in accordance with claim 1 wherein each feed lip wall defines a recess in communication with the gap, the recess is configured to receive a rimmed end of the nominal 2.5 inch long .410 bore shotgun shell.

* * * * *